US006415456B1

(12) United States Patent
Lordahl et al.

(10) Patent No.: US 6,415,456 B1
(45) Date of Patent: Jul. 9, 2002

(54) ADJUSTABLE UNIVERSAL FLAPPER

(75) Inventors: Var Lordahl, 1571 Schaeffer Rd., Long Grove, IL (US) 60047; Scott H. Koepsel, Winthrop Harbor, IL (US)

(73) Assignee: Var Lordahl, Long Grove, IL (US)

( * ) Notice: Subject to any disclaimer, the term of this patent is extended or adjusted under 35 U.S.C. 154(b) by 0 days.

(21) Appl. No.: 09/721,593

(22) Filed: Nov. 22, 2000

(51) Int. Cl.[7] ..... E03D 1/34
(52) U.S. Cl. ..... 4/393; 4/394; 4/402; 4/412
(58) Field of Search ..... 4/392, 393, 394, 4/402, 403, 404, 412

(56) References Cited

U.S. PATENT DOCUMENTS 3,590,396 A * 7/1971 Graziosi ..... 4/393
5,173,971 A * 12/1992 Schoepe et al. ..... 4/393 X

* cited by examiner

*Primary Examiner*—Robert M. Fetsuga
(74) *Attorney, Agent, or Firm*—Kajane McManus

(57) ABSTRACT

The adjustable flapper comprises at least an adjustable flapper comprising at least a base to which is adjustably engaged a seal assembly including a seal, the seal depending from the base, and the seal assembly being movable in at least one desired direction relative to the base to accommodate any required distancing of the seal from a free end of the base and the seal being adjustable in angulation relative to the base.

17 Claims, 4 Drawing Sheets

ADJUSTABLE UNIVERSAL FLAPPER

BACKGROUND OF THE INVENTION

1. Field of the Invention

The present invention relates to an adjustable toilet tank flapper. More particularly, the adjustable flapper is proposed for use in most toilet tanks of the type which use 1.6 gallons of water per flush (gpf), as well as older larger sized toilet tanks using standard tank balls.

2. Prior Art

Heretofore, 1.6 gpf toilet tanks have been created by numerous manufacturers. The interior structure of each manufacturer's tank has differed in configuration to an extent where the flapper of each manufacturer has not always been interchangeable nor has there been to date a flapper which will accommodate use in 1.6 gpf tanks of most, if not all, manufacturers.

In this respect, the configuration of interior components of the tanks of the various manufacturers has differed in primarily two significant parameters. The first is the distance between the flush tube, to which one end of the flapper is typically anchored, and the water outlet against which the flapper seal must securely seat in water tight manner, and the second is the angle at which the water outlet is oriented relative to the horizontal.

Thus there has existed a need in the industry for a flapper which allows for the seal of the flapper not only to be adjustable in its distance from the anchor end of the flapper but also to be adjustable in the angulation of the seal relative to a planar base of the flapper, from which the seal depends, to assure secure and water tight seating of the seal in the water outlet of the toilet tank.

SUMMARY OF THE INVENTION

According to the invention there is provided an adjustable flapper which can be used with substantially any internalized configuration of components of toilet tanks of at least 1.6 gallon per flush capacity, the flapper comprising at least a base to which is adjustably engaged a seal assembly incorporating a seal, the seal depending from the base, and being movable in at least one desired direction relative to the base to accommodate required distancing of the seal from an anchor end of the base and required angulation of the seal relative to the base to ensure appropriate seating of the seal.

DESCRIPTION OF THE PREFERRED EMBODIMENT

Figure 1:
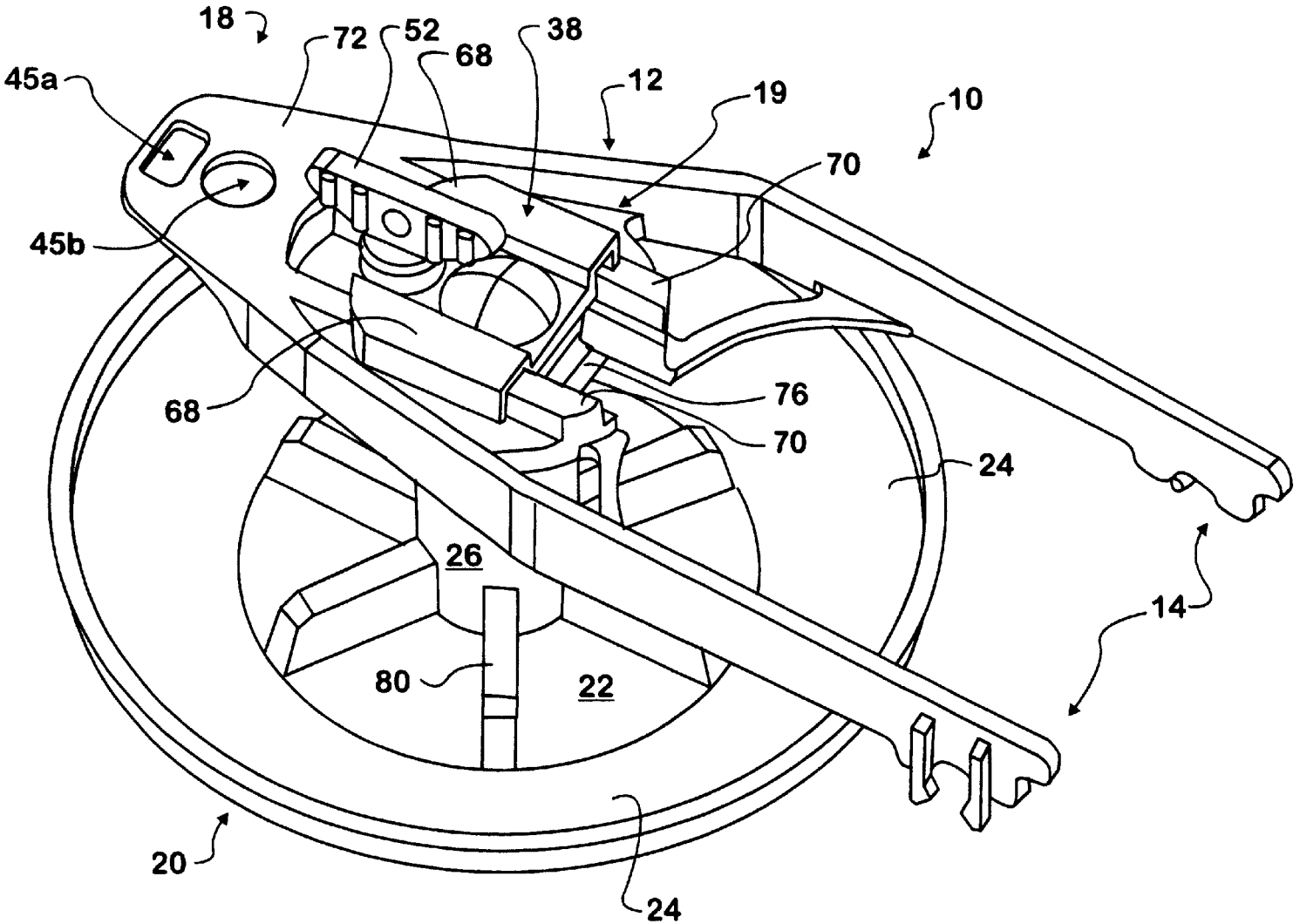
FIG. 1 is a perspective top view of the adjustable universal flapper of the present invention.

Referring now to the drawings in greater detail, there is illustrated therein the adjustable universal flapper made in accordance with the teachings of the present invention and generally identified by the reference numeral 10.

As illustrated, the flapper 10 includes a substantially planar base 12 having a first or anchor end 14 adapted to anchor the base 12 to a flush tube of a toilet tank (not shown), in known manner.

Engaged to the base 12 toward a second or free end 18 thereof is a seal assembly 19 which engages the base 12. The seal assembly 19 includes a depending seal 20 having a planar bottom wall 22 and an outwardly and upwardly angulated peripheral wall 24.

Extending upwardly from a center point of the planar bottom wall 22 is a centered hollow shaft 26. The shaft 26 fixedly engages one end 28 of an engagement pin 30 of the seal assembly 19. A second end 32 of the engagement pin 30 terminates in a spherical tip or end nub 34. This spherical tip 34 is received within a cooperating cavity 36 in a slide 38 of the seal assembly 19 in a manner where the nub 34 is angularly adjustable within the cavity 36, allowing for the bottom wall 22 of the seal 20 to be set at substantially any required angle relative to the base 12 for appropriate seating thereof.

The slide 38 is further adapted to be slidably engaged within a cooperating channel 40 in the base 12, the slide 38 allowing for adjustability of the distance between the seal 20 and the anchor end 14 of the flapper 10.

Figure 6:
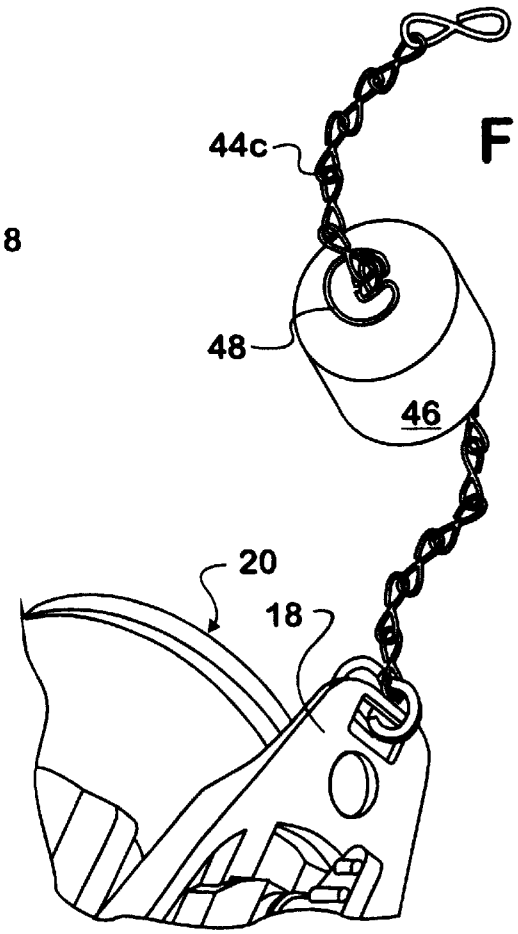
FIG. 6 is a broken away view of a free end of the flapper base showing accommodation of a strap and float combination.
Figure 5:
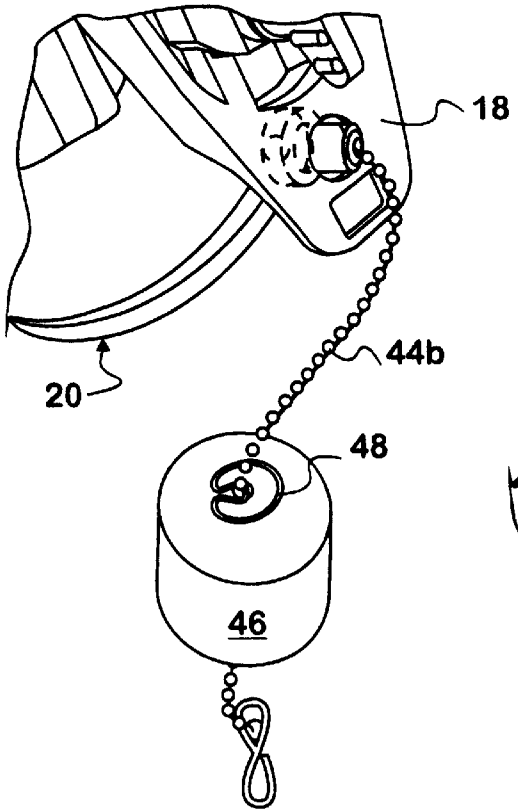
FIG. 5 is a broken away view of a free end of the flapper base showing accommodation of another form of chain and float combination.
Figure 4:
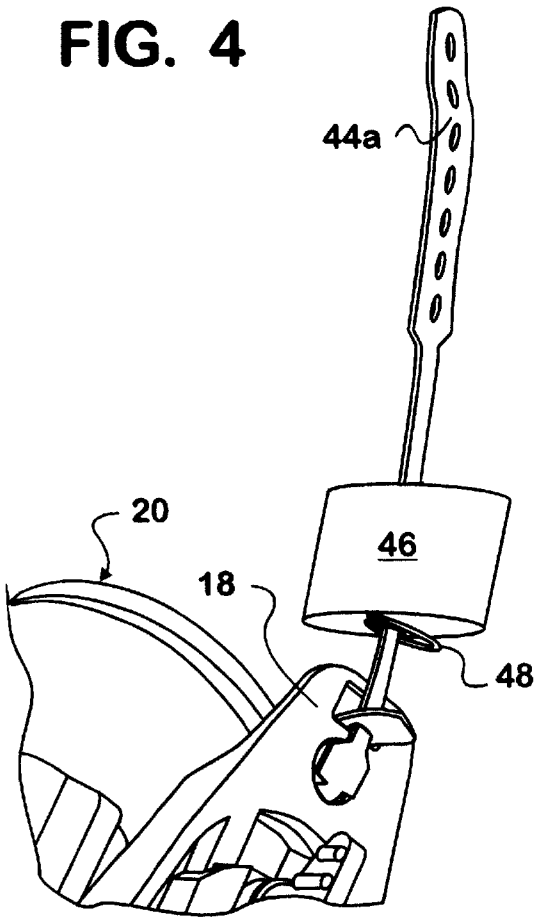
FIG. 4 is a broken away view of a free end of the flapper base showing accommodation of one form of chain and float combination.

The second or free end 18 of the flapper 10 is configured to accommodate the most common variations of flapper chains, commonly referenced 44 Three of the most common embodiments 44*a*, 44*b*, and 44*c*, are illustrated in FIGS. 4–6, respectively. Two ports 45*a* and 45*b* are provided in the free end 18 for use in engaging a chain 44 thereto. Port 45*a* is configured to be rectangular and port 45*b* is configured to be circular, for assuring engageability of most chain 44 embodiments presently used, to the flapper 10.

It will be understood that a float 46 made of foam rubber or the like must be engaged to the chain 44 because the bottom wall 22 of the seal 20 is flat, and therefore unable to contain an air bubble thereunder, which typically has served to float the seal 20 in prior art flappers. Thus, the float 46 replaces the function of the prior art air bubble. It will be understood that the float 46 must be secured to the chain 44 at a particular level to allow for appropriate float duration for the flapper 10 to correctly fill a toilet bowl (not shown). Thus, the float 46 is secured to the chain 44 by means of top and bottom clips 48, as shown in FIGS. 4–6.

Returning to the flapper 10, in use, it will be understood that once the relative angulation of the seal 20 to the base 12 is set to assure water tight seating of the seal 20 within a water outlet of a toilet tank (not shown), regardless of the orientation of the water outlet, a frictional clamp 50 of the seal assembly 19 cooperates with the slide 38, the clamp 50 having a portion 77 that engages slot 40 in base 12 from an underside 51 of the base 12, and a connector 52 of the seal assembly 19, such as a threaded thumbscrew 52.

Figure 2:
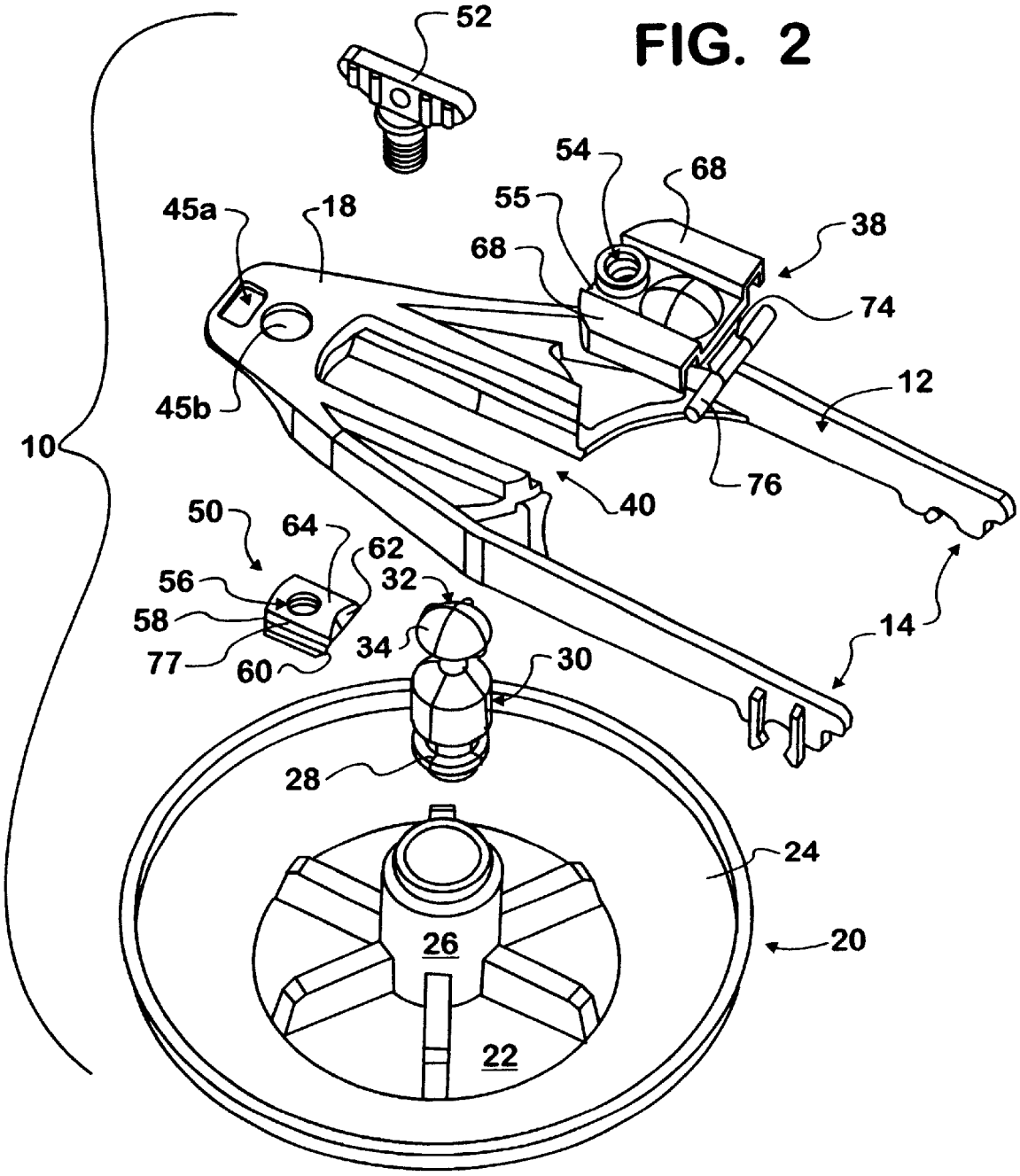
FIG. 2 is a blown apart perspective view of the flapper of FIG. 1 showing the individual Components thereof.
Figure 3:
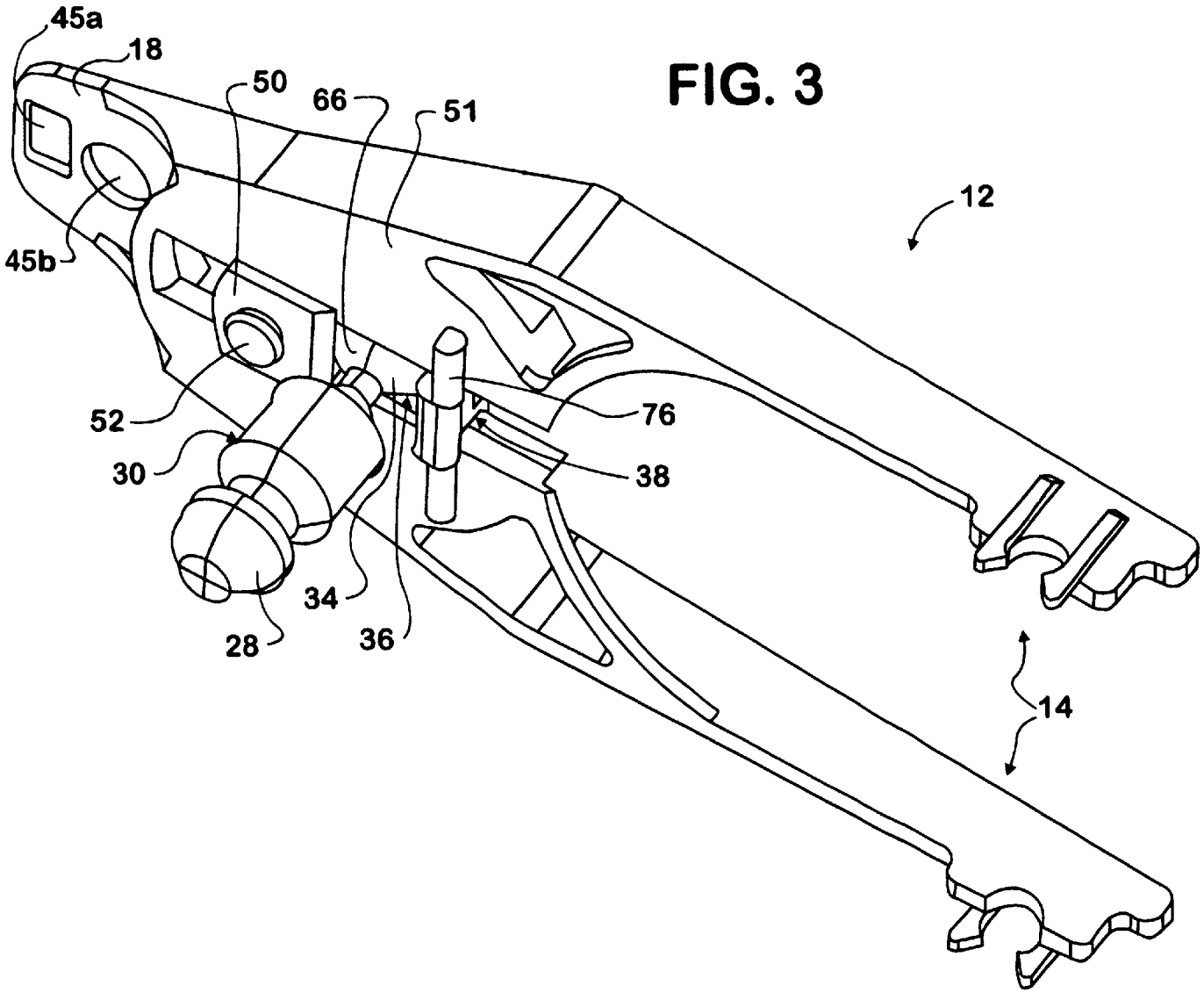
FIG. 3 is a perspective bottom view of a base of the flapper with a seal thereof removed to show intermediate structures of a seal assembly of the flapper more clearly.

A concurrent perusal of FIGS. 2 and 3 will best detail the seal assembly 19.

It will be seen that the slide 38 incorporates a throughbore 54 in one end 55 thereof adjacent the semispherical cavity 36.

It will also be seen that the frictional clamp 50 includes a threaded throughbore 56 therein, toward a first end 58 thereof.

A second end 60 of the frictional clamp 50 includes an undercut area 62 on an upper surface 64 thereof which mimics the shape of an undersurface 66 of the spherical tip 34 of the engagement pin 30 so that, when the clamp 50 is compressed against the undersurface 66, the spherical tip 34 is maintained at a required angulation relative to the base 12 for proper seating.

Compression of the frictional clamp 50 is created by inserting the thumbscrew 52 into and through the throughbore 54 in the slide 38 and threading into and through the throughbore 56 in the clamp 50, once the desired angulation of the tip 34 and hence the seal 20 depending therefrom is set, and once the position of the seal assembly 19, relative to anchor end 14 of the base 12 is set.

Thus, it will be understood that the thumbscrew 52 accomplishes two goals simultaneously.

This is possible because slide 38 engages over the base 12, while the clamp 50 engages under the base 12, sandwiching the base 12 therebetween.

In this respect, it will be seen that the major portion of clamp 50 is wider than the slot 40 in the base 12 and has a portion 77 that engages in slot 40 from the underside 51 of the base 12 and that the slide 38 is not only wider than the slot 40 but includes lateral flanges 68 which engage over lateral tracks 70 on an upper surface 72 of the base 12, to ensure alignment between the slide 38 and base 12, with another end 74 of the slide 38 being provided with a depending cross rod retainer 76 which slides along and against the underside 51 of the base 12, maintaining the end 74 of the slide 38 against the upper surfae 72 of the base 12.

Further, as in the preferred embodiment shown, radial ribs 80 may be provided across the bottom surface 22 of the seal 20 to provide support and strength thereto.

As described above, the flapper 10 provides a number of advantages, some of which have been described above, and others of which are inherent in the invention. Also, modifications can be proposed to the flapper 10 without departing from the trackings herein. Accordingly, the scope of the invention is only to be limited as necessitated by the accompanying claims.

What is claimed is:

1. An adjustable flapper comprising at least a base to which is adjustably engaged a seal assembly including a seal, the seal depending from the base, and the seal assembly being movable relative to the base to accommodate any required positioning of the seal relative to a free end of the base, the required positioning being mechanically maintainable.

2. An adjustable flapper comprising at least a base to which is adjustably engaged a seal assembly including a seal, the seal depending from the base, and being adjustable in angulation relative to the base, the angulation being mechanically maintainable.

3. An adjustable flapper comprising at least a base to which is adjustably engaged a seal assembly including a seal, the seal depending from the base, and the seal assembly being movable in at least one desired direction relative to the base to accommodate any required distancing of the seal from a free end of the base and the seal being adjustable in angulation relative to the base, both distancing and angulation mechanically maintained.

4. The flapper of claim 3 wherein the seal comprises a planar bottom wall having a radially outwardly and upwardly extending peripheral wall therearound.

5. The flapper of claim 4 wherein the planar bottom wall includes a centered hollow shaft extending upwardly therefrom.

6. The flapper of claim 5 wherein an engagement pin is fixedly engaged at one end to the centered hollow shaft.

7. The flapper of claim 6 wherein the engagement pin has a spherical tip at another end thereof.

8. The flapper of claim 7 wherein the base of the flapper incorporates a slot therein within which a slide is slidingly received.

9. The flapper of claim 8 wherein the slide incorporates an at least semispherical hollow in an undersurface thereof within which at least a portion of the somewhat spherical tip of the engagement pin nests.

10. The flapper of claim 8 wherein the slide incorporates lateral flanges, each of which engages over a corresponding lateral track, the slot being defined between the lateral tracks.

11. The flapper of claim 8 wherein the slot is positioned toward a free end of the base.

12. The flapper of claim 8 wherein the slide incorporates a throughbore adjacent the semispherical cavity.

13. The flapper of claim 8 wherein a frictional clamp is provided having a threaded througbore therein toward a first end thereof.

14. The flapper of claim 13 wherein the frictional clamp engages against an undersurface area of the spherical tip of the engagement pin which extends downwardly outwardly of the semispherical cavity in the slide, the clamp having an undercut area on an upper surface of a second end thereof for assuring frictional engagement against an abutting undersurface area of the spherical tip for maintaining required angulation of the seal.

15. The flapper of claim 8 wherein a thumbscrew is provided for engaging the slide and the frictional clamp together, the thumbscrew simultaneously locking the spherical tip in required angulated position and locking the sliding element in appropriate position within the slot of the base.

16. The flapper of claim 3 wherein the free end of the base includes at least two differently configured ports therein for universally accommodating any flapper chain.

17. The flapper of claim 16 wherein the flapper chain incorporates a float which is secured to the chain at an appropriate position therealong for assuring appropriate float duration for the flapper.

* * * * *